United States Patent [19]

Ueda

[11] 4,347,500

[45] Aug. 31, 1982

[54] ELECTRIC ALARM DEVICE

[75] Inventor: Mitsuru Ueda, Aichi, Japan

[73] Assignee: Nippondenso Co., Ltd., Kariya, Japan

[21] Appl. No.: 181,392

[22] Filed: Aug. 25, 1980

[30] Foreign Application Priority Data

Sep. 7, 1979 [JP] Japan ..... 54-115475

[51] Int. Cl.[3] ..... G08B 3/00; G10K 9/00

[52] U.S. Cl. ..... 340/388; 340/404

[58] Field of Search ..... 340/404, 388, 389, 390, 340/391

[56] References Cited

U.S. PATENT DOCUMENTS 1,209,403 12/1916 Dean ..... 340/388

1,231,835 7/1917 Ames ..... 340/388

1,243,047 10/1917 Dean ..... 340/388

*Primary Examiner*—Thomas A. Robinson

*Assistant Examiner*—Daniel Myer

*Attorney, Agent, or Firm*—Cushman, Darby & Cushman

[57] ABSTRACT

In an electric alarm device, a disk-shape housing has an opening on one surface and a substantially flat bottom surface on the other surface. A diaphragm is fixed to the periphery of the housing to close the opening of the housing. An armature is mounted within the housing and coupled to the diaphragm to move with the diaphragm. A solenoid coil unit is fixed to the housing within the housing to generate magnetic fluxes for attracting the armature. A switch is mounted within the housing to detect the movement of the diaphragm to conduct and break the current to the solenoid coil unit.

11 Claims, 15 Drawing Figures

ELECTRIC ALARM DEVICE

The present invention relates to an improved structure of an electric alarm device such as horn or buzzer used in automobiles or the like.

As an example of prior art electric alarm devices, a horn is specifically explained.

It is an object of the present invention to provide an electric alarm device which has four magnetic poles constituting solenoid coils with each magnetic pole generating small attraction force and having low height to reduce impact force which each magnetic pole imparts to a housing, and in which impact force generated when an armature intermittently acts on the magnetic poles at high speed is distributed in four portions of the housing so that the thickness of the electric alarm device can be reduced and a thin and light housing of relatively small mechanical strength can be used.

The present invention will be apparent from the following description taken in conjunction with the accompanying drawings, in which.

Figure 1:
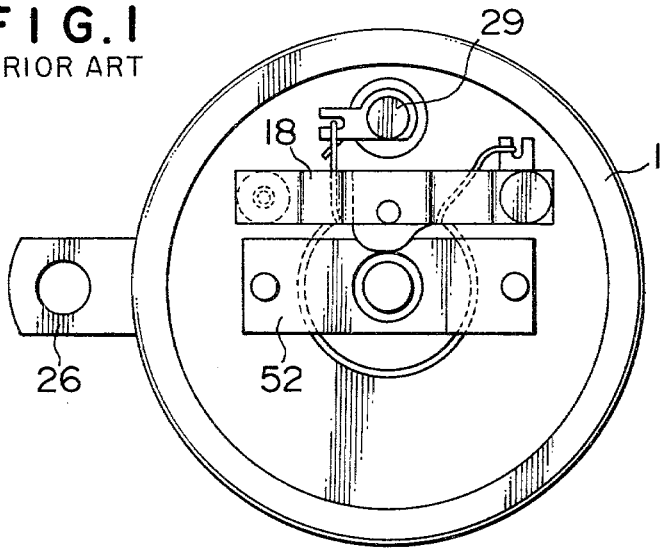
FIG. 1 PRIOR ART
FIG. 1 is a plan view of an internal arrangement of a known electric alarm device.
Figure 2:
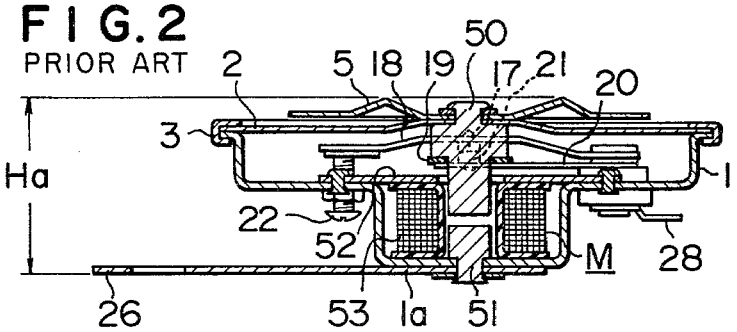
FIG. 2 PRIOR ART
FIG. 2 is a longitudinal sectional view of the electric alarm device shown in FIG. 1.
Figure 3:
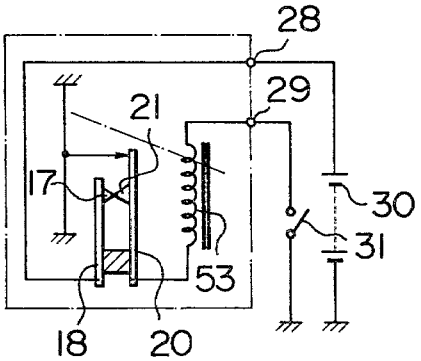
FIG. 3 PRIOR ART
FIG. 3 is an electric circuit diagram of the electric alarm device shown in FIG. 1.

Referring to FIGS. 1 to 3, a prior art horn is shown, which comprises a second generating resonance plate 5 and a diaphragm 2 fixed by a moving core 50, and a solenoid coil M including a stationary core 51, a plate 52, a bottom 1*a* of a housing 1 and a coil 53.

In this arrangement, the bottom of the housing for accommodating the coil 53 forms a large projection in the product and hence the thickness Ha of the product shown in FIG. 2 is necessarily large.

In the alarm device for the automobile, it is efficient to mount the alarm device in a front area of the automobile in order to enhance the sound energy forward of the automobile. An appropriate mounting area would be a space between a radiator grill and a panel or between a bumper and the panel. This space, however, is too small to mount the device therein and in many cases the device is not satisfactorily mounted. It is particularly difficult to do this in a compact size car, and more difficult when other equipment such as a condenser for an air conditioner is mounted on the front of the radiator. Accordingly, a thinner device has been required.

It is natural from the directivity of a flat type electric alarm device that the acoustic energy is more efficiently propagated when the sound generating plate of the flat type electric alarm device is faced to the direction of movement of the car. Accordingly, thinner device has been desired.

A spiral electric alarm device having a spiral chamber on the front of the flat type electric alarm device is thick in nature. If the thickness of this device can be reduced, it may be more readily mounted in an engine room having a limited mounting space.

Figure 4:
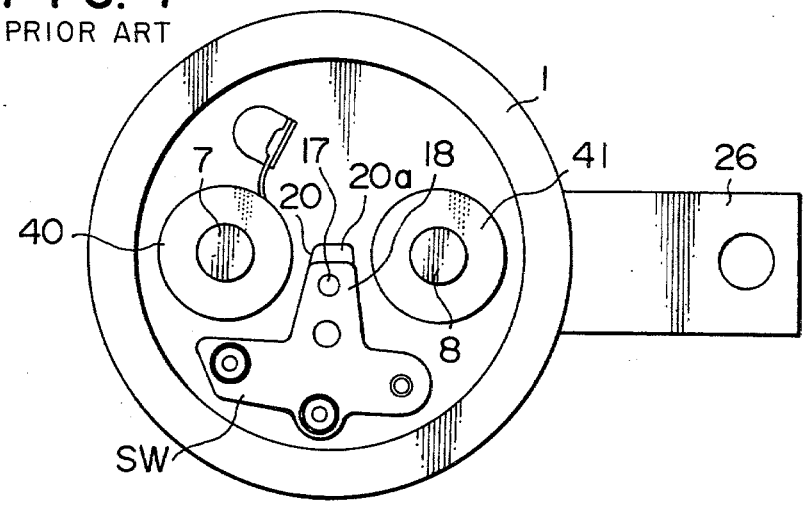
FIG. 4 PRIOR ART
FIG. 4 is a plan view of an internal arrangement of a known electric alarm device.
Figure 5:
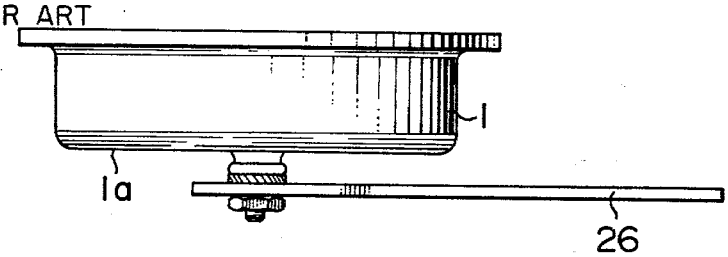
FIG. 5 PRIOR ART
FIG. 5 is a fragmentary side elevational view of the electric alarm device shown in FIG. 4.
Figure 6:
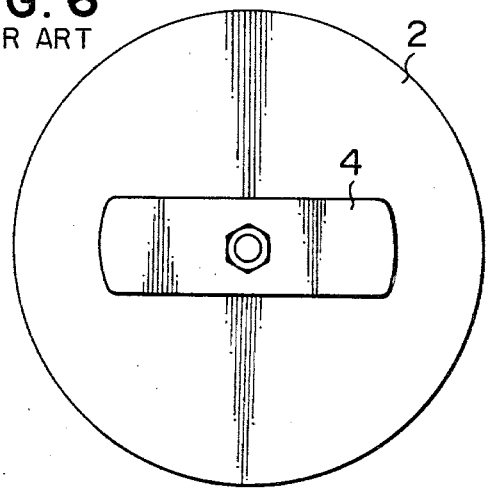
FIG. 6 PRIOR ART
FIG. 6 is a plan view of an armature and a diaphragm used in the electric alarm device shown in FIG. 4.

A known electric alarm device which is closest in structure to the electric alarm device of the present invention is shown in FIGS. 4 to 6. In this device, in order to increase sound pressure of the electric alarm device, the solenoid coil is divided into two parts 40 and 41, and contact springs 18 and 20, which form an electric contact mechanism SW having a strong spring characteristic, are provided.

While this electric alarm device is more suitable for a flat or space saving alarm device than that shown in FIG. 1, it has the following disadvantage.

The magnetic pole section of this electric alarm device is divided into two magnetic poles 7 and 8, but the solenoid coils 40 and 41 of the respective magnetic poles 7 and 8 are still too large and high to provide a flat electric alarm device. Although the magnetic pole section is divided into two parts 7 and 8, the impact force imparted to the bottom 1*a* of the housing 1 located at the bases of the magnetic poles 7 and 8 by the armature 4 which collides by the attracting forces of the magnetic poles 7 and 8 is so large that the housing 1 needs large mechanical strength.

The preferred embodiments of the electric alarm device of the present invention will now be explained.

Referring to FIGS. 7 to 10 which show a first embodiment of the present invention, numeral 1 denotes a housing which is of disk shape having an upward opening. In the present embodiment, it is molded from synthetic resin. Numeral 2 denotes a diaphragm a periphery of which is clamped to the housing 1 by an outer peripheral ring 3. Numeral 4 denotes an armature made of steel and numeral 5 denotes a sound generating resonance plate which is coupled to the armature 4 by a rivet 6. Numeral 7 denotes a first magnetic pole, numeral 8 denotes a second magnetic pole, numeral 9 denotes a third magnetic pole and numeral 10 denotes a fourth magnetic pole. Those magnetic poles 7, 8, 9 and 10 are clamped to the bottom 1*a* of the housing 1.

Numeral 11 denotes a first core of bar steel which links the first magnetic pole 7 and the second magnetic pole 8. Numeral 12 denotes a second core which links the third magnetic pole 9 and the fourth magnetic core 10. Numerals 13 and 14 denote coils which are wound around the first core 11 and the second core 12, respectively. Numerals 7A, 8A, 9A and 10A denote cores. The first to fourth magnetic poles 7, 8, 9 and 10, the cores 7A, 8A, 9A and 10A, the first and second cores 11 and 12, and the coils 13 and 14 constitute a solenoid coil unit M. Symbol SW denotes an electric contact mechanism which functions as switching means. The mechanism SW has a through-hole 16, an upper contact spring 18 having a fixed upper contact 17 and a lower contact spring 20 which opposes to the upper contact spring 18 with an insulating plate 19 being interposed therebetween. Fixed to the lower contact spring 20 is a lower contact 21 which is pressed to contact to the upper contact 17 when the coils 13 and 14 of the solenoid coil unit M are not energized to form a normally closed contact mechanism.

Fixed to the bottom of a tip end 18*a* of the upper contact spring 18 is an insulating plate 19A the bottom of which is lifted up by an adjusting screw 22 which acts as an adjusting member.

The upper contact spring 18, the insulating plate 19 and the lower contact spring 20 are fixed to the housing 1 by a rivet 23.

Numeral 24 denotes an insulative sleeve which insulates the upper contact spring 18 and the lower contact spring 20 from the housing 1.

A projection 6*a* at the bottom of the rivet 6 which clamps the armature 4 and the sound generating resonance plate 5 extends through the through-hole 16 in the upper contact spring 18 to abut against the insulating plate 19. When the projection 6*a* moves downward, the insulating plate 19 and the lower contact spring 20 deflect downward so that the conduction between the upper contact 17 and the lower contact 21 is blocked and energization current to the coils 13 and 14 is blocked.

Numeral 26 denotes a mounting stay, numeral 27 denotes a rivet for coupling the mounting stay 26 to the housing 1 and numerals 28 and 29 denote terminals. The terminal 28 is connected to a battery 30 while the terminal 29 is connected to a horn switch 31.

The operation of the first embodiment thus constructed is now explained.

When the horn switch 31 is turned on, a current flows from the battery 30 through the terminal 28, the first coil 13, the upper contact spring 18, the upper contact 17, the lower contact 21, the lower contact spring 20, the second coil 14 and the terminal 29 so that the solenoid coil unit functions as an electromagnet to magnetize the first magnetic pole 7 and the fourth magnetic pole 10 to the S pole and the second magnetic pole 8 and the third magnetic pole 9 to the N pole. As a result, the armature 4 is attracted by the first through fourth magnetic poles 7, 8, 9 and 10 and the diaphragm deflects downward. The projection 6*a* also moves downward so that the tip end of the projection 6*a* pushes down on action point 20*a* of the lower contact spring 20 through the insulating plate 19.

As a result the conduction between the upper contact 17 and the lower contact 21 is blocked and the coils 13 and 14 are again deenergized. As a result, the attraction force between the armature 4 and the first through fourth magnetic poles 7, 8, 9 and 10 disappears, and the armature 4 and hence the projection 6*a* of the rivet 6 again move upward by the restoring spring force of the diaphragm 2.

This operation is repeated so that the diaphragm 2 vibrates. The dimensions of the respective components are selected such that the frequency of the vibration ranges between 300 Hz and 500 Hz.

While the housing 1 in the first embodiment is made of synthetic resin in order to allow the magnetic fluxes to effectively link to the armature 4, it may be made of aluminum or brass.

Figure 7:
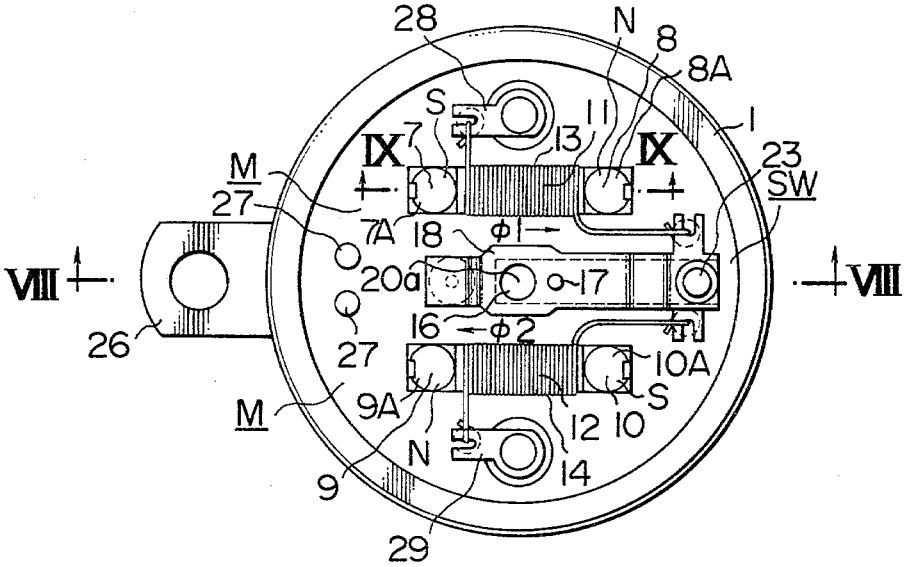
FIG. 7 is a plan view showing an internal arrangement of a first embodiment of the electric alarm device of the present invention.

The directions of the magnetic fluxes flowing in the first coil 13 and the second coil 14 are shown by arrows $\phi_1$ and $\phi_2$, respectively, in FIG. 7.

As described above, in the first embodiment, four magnetic poles 7, 8, 9 and 10 are provided so that the height of the solenoid coil unit M can be extremely reduced. Furthermore, since the electric contact mechanism in the form of the switching means SW is provided among the magnetic poles 7, 8, 9 and 10 which constitute the solenoid coil unit M, the overall height of the alarm device is very small as shown by the height H in FIG. 8 so that a flat alarm device can be provided.

The alarm device in accordance with the first embodiment has a further advantage, although it is a known advantage, in that since the projection 6*a* of the rivet 6 and the lower contact spring 20 abut against each other on a center axial line of the lower contact spring 20, the lower contact spring 20 does not produce torsion when the projection 6*a* depresses the lower contact spring 20 downward at the action point 20*a* so that the electric contacts 17 and 21 are positively made and broken.

Figure 8:
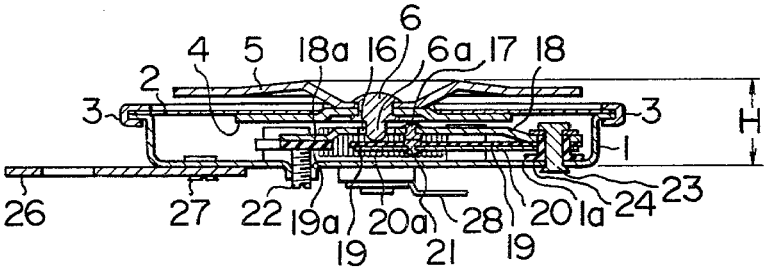
FIG. 8 is a longitudinal sectional view, taken along a line VIII—VIII, of the electric alarm device shown in FIG. 7.

As is apparent from FIGS. 7 and 8, the center of the rivet 23, the centers of the contacts 17 and 18, the action point 20*a* and the center of the adjusting screw 22 lie on the center line which divides the housing 1 so that the elongated electric contact mechanism SW as a whole is formed.

In the first embodiment, the armature 4 is round in shape and the center of the armature 4 positionally coincides with the center of the diaphragm 2 and hence the center of the housing 1. The four magnetic poles 7, 8, 9 and 10 are arranged in a square so that they are equally displaced from the center of the armature 4. Each of the magnetic poles 7, 8, 9 and 10 generates the same magnitude of attraction force.

Accordingly, the armature 4 is not tilted by the attraction forces of the magnetic poles 7, 8, 9 and 10, that is, it moves parallel to the plane of the bottom 1*a* of the housing 1 and is attracted to the magnetic poles 7, 8, 9 and 10.

If the armature 4 were to tilt and abut against the magnetic poles 7, 8, 9 and 10, deformation of the diaphragm 2 would occur and the quality of sound would be deteriorated. However, since the magnetic poles 7, 8, 9 and 10 are arranged in a square and the armature 4 is round, such deterioration is avoided.

In addition, since the armature 4 is round, no serious problem will occur even if the armature 4 is misaligned to the magnetic poles 7, 8, 9 and 10 in a manner that the armature is rotated.

In this regard, since the known alarm device shown in FIGS. 4 to 6 uses the rectangular armature 4, the armature 4 may not be properly attracted to the magnetic poles 7 and 8 if the armature 4 is not accurately positioned to allow the rotation between the armature 4 and the magnetic poles 7 and 8. As a result, the efficiency is lowered and the quality of sound is deteriorated.

The magnetic poles 7, 8, 9 and 10 may be arranged in a rectangle rather than in a square. In this case, they are symmetrically arranged around the center axial line of the switching means SW, i.e., the two magnetic poles on each side of the center axial line, and the armature 4 may be of rectangular shape or polygonal shape if it is accurately positioned.

A second embodiment of the alarm device of the present invention is now explained.

The second embodiment is common to the first embodiment in the sound generating resonance plate 5, rivet 6, armature 4, diaphragm 2, external peripheral ring 3, mounting stay 26, adjusting screw 22, upper contact spring 18, upper contact 17, lower contact spring 20 and lower contact 21. Accordingly, those components are not explained here.

Disposed between the upper contact spring 18 and the lower contact spring 20 is a circular insulating plate 19 generally made of ferromagnetic material which extends along the inner diameter of the housing 1.

Figure 13:
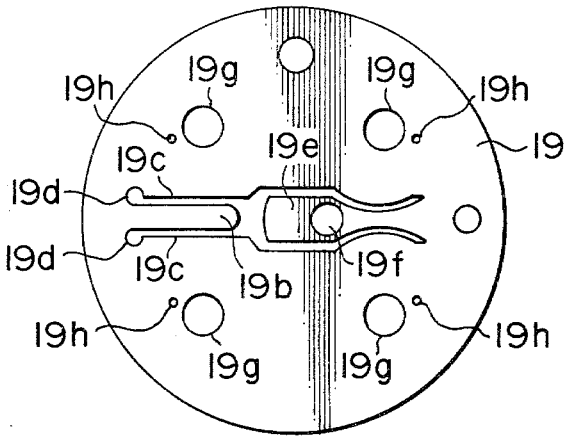
FIG. 13 is a plan view of an insulating plate used in the electric alarm device shown in FIG. 11.
Figure 14:
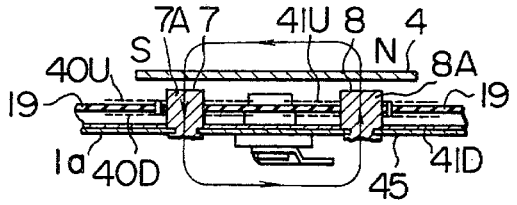
FIG. 14 is a fragmentary sectional view, taken along a line XIV—XIV of FIG. 11.

The shape of the insulating plate 19 is shown in FIG. 13, in which numeral 19*b* denotes a finger member which is defined by grooves 19*c* and circular holes 19*d*. The tip end of the finger member 19*b* is inserted between an adjusting screw 22 and the tip end 18*a* of the upper contact spring 18. The adjusting screw 22 is electrically insulated from the upper contact spring 18.

Numeral 19*e* denotes a movable insulating plate held between the upper contact spring 18 and the lower contact spring 20. The movable insulating plate 19*e* has a small hole 19*f* in which the upper contact 17 and the lower contact 21 are inserted.

The projection 6*a* of the rivet 6 abuts against the tip end of the movable insulating plate 19*e*. As the armature 4 moves downward to move the projection 6*a* of the rivet 6 downward, the movable insulating plate 19*e* also deflects downward, and the lower contact spring 20 also deflects downward to break the contact between the upper contact 17 and the lower contact 21. An insulative sheet 35 is bonded to the bottom 1*a* of the housing 1 so that the lower contact spring 20 is insulated from the housing 1.

A rivet 36 and an insulative sleeve 37 extend through the upper contact spring 18, the insulating plate 19, the lower contact spring 20 and the insulative sheet 35, and the rivet 36 are electrically insulated from the lower contact spring 20 and the housing 1 by the insulative sleeve 37. The upper contact spring 18 is electrically connected to the terminal 28 through the rivet 36.

The solenoid coil unit M is now explained. Numerals 7A, 8A, 9A and 10A denote cores the bottoms of which are clamped to the bottom 1*a* of the housing 1. The cores 7A, 8A, 9A and 10A are of cylindrical body made ferromagnetic material such as steel.

The cores 7A, 8A, 9A and 10A are inserted into a through-hole 19*g* of the insulating plate 19 and the upper surfaces of the cores 7A, 8A, 9A and 10A form the magnetic poles 7, 8, 9 and 10.

Of those magnetic poles 7, 8, 9 and 10, the first magnetic pole 7 is magnetized to the S pole, the second magnetic pole 8 to the N pole, the third magnetic pole 9 to the N pole and the fourth magnetic pole 10 to the S pole, by coils 40, 41, 42 and 43, respectively, to be described later.

Provided on the upper and lower surfaces of the insulating plate 19 are spiral coils 40, 41, 42 and 43 which surround the cores 7A, 8A, 9A and 10A, respectively. Those spiral coils 40, 41, 42 and 43 are made of copper foil and manufactured by an etching process, for example.

More particularly, the copper foil is plated or bonded to the insulating plate 19 made of epoxy resin or bakelite, and the copper foil is etched away while leaving the copper foil portions corresponding to the spiral coil areas, to form the spiral coils 40, 41, 42 and 43. In the second embodiment, each core (e.g. 7A) has a pair of spiral coils (e.g. 40U and 40D) on front and back surfaces of the core and those front and back spiral coils are separately provided on the upper surface and the lower surface of the insulating plate 19 and they are interconnected by a crossover line 45 (FIG. 15) which extends through a wiring through-hole 19*h* of the insulating plate 19.

Figure 15:
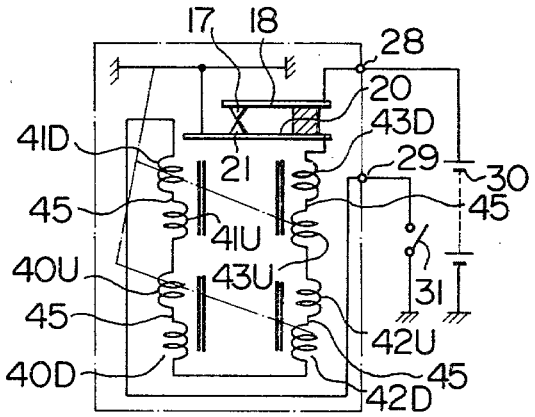
FIG. 15 is an electric circuit diagram of the electric alarm device shown in FIG. 11.

FIG. 15 shows an electric circuit diagram of the second embodiment.

A current flow path is now explained.

A current flows from the positive terminal 28 of the power supply 30, through the upper contact spring 18, the upper contact 17, the lower contact 21, the lower contact spring 20, the outer portion through the center portion of the lower spiral coil 43D of the fourth magnetic pole 10, the crossover line 45, the center portion through the outer portion of the upper spiral coil 43U of the fourth magnetic pole 10, the outer portion through the center portion of the upper spiral coil 42U of the third magnetic pole 9, the crossover line 45, the center portion through the outer portion of the lower spiral coil 42D of the third magnetic pole 9, the outer portion through the center portion of the lower coil 40D of the first magnetic pole 7, the crossover line 45, the center portion through the outer portion of the upper coil 40U of the first magnetic pole 7, the outer portion through the center portion of the upper coil 41U of the second magnetic pole 8, the crossover line 45, the center portion through the outer portion of the lower coil 41D of the second magnetic pole 8, the terminal 29 and the horn switch 31.

As a result, the magnetic poles 7, 8, 9 and 10 are magnetized in the manner described above so that the armature 4 is attracted by the magnetic poles 7, 8, 9 and 10.

The operation of the second embodiment is identical to that of the first embodiment. That is, the projection 6*a* of the rivet 6 depresses the lower contact spring 20 to open the normally closed electric contacts 17 and 21 to block the currents through the spiral coils 40, 41, 42 and 43. The detail of the operation is therefore omitted here.

In the second embodiment, the first spiral coils 40U, 41U, 42U and 43U and the second spiral coils 40D, 41D, 42D and 43D are provided on the upper surfaces and the lower surfaces of the magnetic poles 7, 8, 9 and 10, respectively. If the first spiral coil (e.g. 43D) is connected such that the current flows from the outer portion to the center portion, the second spiral coil (e.g. 43U) is connected such that the current flows from the center portion to the outer portion. The first and second spiral coils (e.g. 43U and 43D) generate the magnetic fluxes in the same direction.

In the second embodiment, the insulating plate 19 is a single plate in which the finger member 19*b* and the movable insulating plate 19*e* are formed by pressing process. Accordingly, it is readily manufactured.

The spiral coils 40, 41, 42 and 43 in the second embodiment may be manufactured, instead of by etching process, by blanking copper foil in spiral shape by a press machine and bonding them on the insulating plate 19, or by winding wire in spiral shape and squeezing it into a flat coil.

Other modifications are now explained.

While the switching means having the electric contacts and the contact springs are used in the first and second embodiments, a contactless switching element may be used to control the coil currents to provide a contactless electric alarm device.

Alternatively, an element (e.g. Hall effect element) which detects the displacement of the armature 4 to generate a signal may be used as the switching element SW and a contactless switching element (e.g. power transistor) through which the coil current flows may be arranged externally of the alarm device. Thus, the switching means SW in the present invention may be that one which is disposed among the magnetic poles 7, 8, 9 and 10 within the housing 1 and detects the displacement of the armature 4 or the diaphragm 2 to control the current flowing through the coils 13 and 14 or 40, 41, 42 and 43 of the solenoid coil unit M.

When the rivet 6 which transmits the displacement of the armature 4 to the lower contact spring 20 is made of insulative material (e.g. synthetic resin), the portion of the insulating plate 19 which lies between the lower contact spring 20 and the rivet 6 may be unnecessary.

The sound generating resonance plate 5 may be omitted. The electric alarm device of the present invention thus include not only the automobile horn but also a buzzer.

Figure 9:
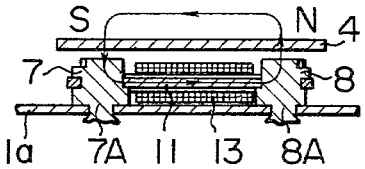
FIG. 9 is a fragmentary sectional view, taken along a line IX—IX of FIG. 7.
Figure 10:
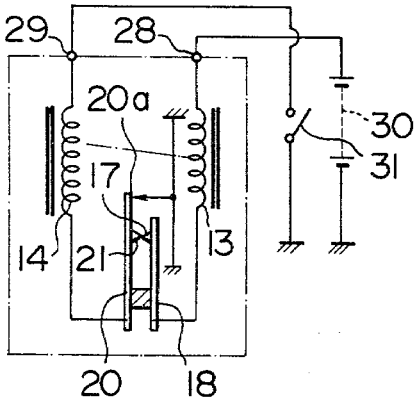
FIG. 10 is an electric circuit diagram of the electric alarm device shown in FIG. 7.
Figure 11:
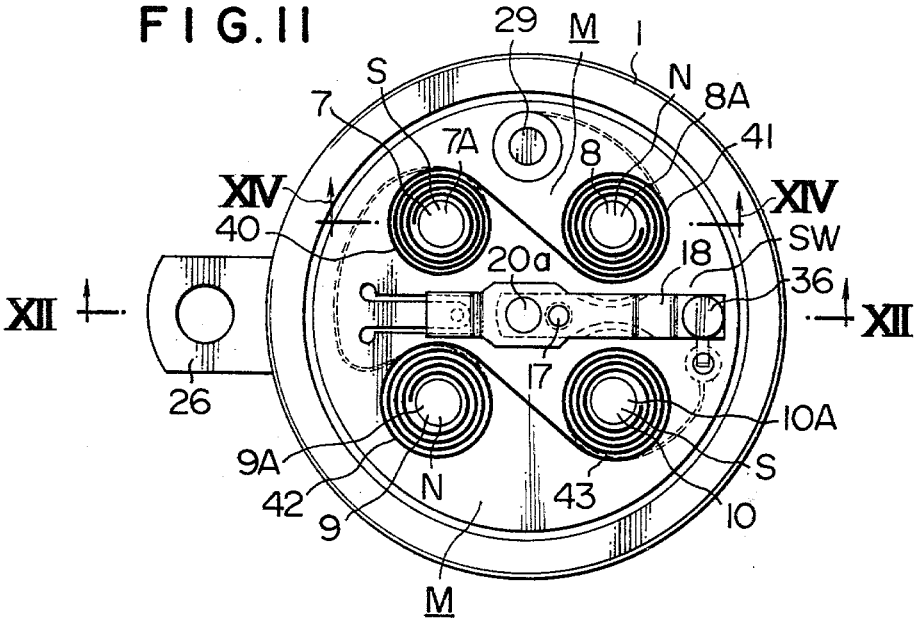
FIG. 11 is a plan view showing an internal arrangement of a second embodiment of the electric alarm device of the present invention.
Figure 12:
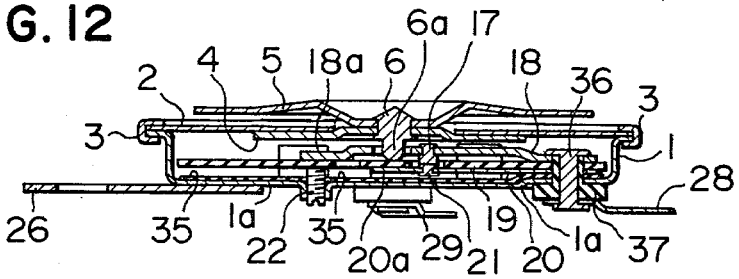
FIG. 12 is a longitudinal sectional view, taken along a line XII—XII, of the electric alarm device shown in FIG. 11.

In the first embodiment, the cylindrical cores 7A and 8A are used to constitute the magnetic poles 7, 8, 9 and 10 as shown in FIG. 9 and those cores 7A and 8A are clamped to the bottom 1*a* of the synthetic resin housing 1. In this case, the bottoms of the cores 7A and 8A are preferably of non-ferromagnetic material in order to prevent the leakage of the magnetic fluxes. Accordingly, the magnetic poles 7 and 8 and the core 11 which bridges the magnetic poles may be integrally manufactured by a U-shape steel bar on which the coil 13 is wound, and the coil 13 and a portion of the U-shape steel bar are fixed to the bottom 1*a* of the housing 1 by molding synthetic resin.

While the magnetic pole planes 7, 8, 9 and 10 in the first embodiment are parallel to the bottom 1*a* of the housing 1, they may be tilted in any degree and they may be shaped such that the magnetic fluxes generated at the coils 13 and 14 effectively flow from the magnetic poles 7, 8, 9 and 10 to the armature 4. In this case, the armature 4 is preferably non-parallel to the bottom 1*a* of the housing 1 but bent to follow the slopes of the tilted magnetic poles 7, 8, 9 and 10.

In the second embodiment, none of the magnetic fluxes generated from the N-pole of the second magnetic pole 8, for example, flow into the S-poles of the other magnetic poles 7 and 10 but some magnetic fluxes from the N-pole of the second magnetic pole 8 pass through a portion of the armature 4 to the outer periphery of the spiral coil 41 back to the S-pole of its own second magnetic pole 8. Since such directly returning magnetic fluxes also contribute to the attraction of the armature 4, the reduction of the magnetic reluctance of the path for the directly returning magnetic fluxes contributes to the enhancement of the attraction force. Accordingly, a plurality of yokes for magnetically coupling the bottom 1*a* of the housing 1 to the armature 4 may be provided on the outer peripheries of the spiral coils 40, 41, 42 and 43. Those yokes may extend through the insulating plate 19 of the second embodiment.

The periphery of the armature 4 may be partially bent to the bottom 1*a* of the housing 1 in order to attain similar effect as that of the yokes.

While the magnetic poles 7, 8, 9 and 10 are magnetized in S, N, N and S poles, respectively, in the second embodiment, they may be magnetized in N, S, N and S poles, respectively.

In the present invention, since four magnetic poles are arranged in plane and in diversed fashion in the housing, and the armature and hence the diaphragm are attracted by the resultant attractive force of the magnetic poles, the respective magnetic poles may be of small size and small height. Accordingly, a flat housing is provided. Furthermore, since the switching means located between the armature and the magnetic poles is buried among the four magnetic poles, the switching means is not obstructive and the magnetic poles can be properly arranged with respect to the armature.

Furthermore, since the mechanical stress which the respective magnetic poles receive from the armature is dispersed to the four portions of the housing, the mechanical strength of the housing is large enough and the quality of the housing is enhanced. As a whole the housing is very thin and can be mounted even in a thin and narrow space.

I claim:

1. An electric alarm device including:

a dish-shape housing having an opening provided at one end thereof and a substantially flat bottom terminating the other end thereof;

a diaphragm having a periphery thereof fixed to said housing to close the opening of said housing;

an armature disposed within said housing and coupled to said diaphragm to move therewith;

a solenoid coil means fixed within said housing for generating magnetic fluxes for attracting said armature; and a switching means disposed within said housing for detecting the movement of said diaphragm to conduct and break current in said solenoid coil means;

wherein:

said solenoid coil means includes: cores projecting from the bottom of said housing and having four magnetic poles arranged in a plane within said housing adjacent to said armature, coils wound on said cores for generating magnetic fluxes linking said cores and said armature, an insulating plate through which said cores project, and at least four coils disposed in a plane on a surface of said insulating plate and spirally wound around said magnetic poles to surround said poles; and said switching means is disposed among said four magnetic poles.

2. An electric alarm device according to claim 1 wherein said switching means includes a lower contact spring which vibrates in response to vibration of said diaphragm transmitted to an action point lying on a center axis line of the lower contact spring, a lower contact fixed to one end of said lower contact spring, the other end of said lower contact spring being retained by a support, an upper contact spring disposed above said lower contact spring and having one end thereof retained by the support and the other end thereof lifted up by an adjusting member provided on said housing, and an upper contact fixed to said upper contact spring;

the retained ends of said upper and lower contact springs, the action point of said lower contact spring and the end of said upper contact spring lifted up by said adjusting member being substantially aligned to form an elongated switching means.

3. An electric alarm device according to claim 1 wherein the center of said armature is located at the center of said housing, said switching means extends in elongated fashion between said magnetic poles, and said four magnetic poles are symmetrically arranged around the center axis line of said switching means.

4. An electric alarm device according to claim 1 wherein said housing is circular in shape, said four magnetic poles are arranged in a square such that they are equally spaced from the center of said housing, and said armature is circular in shape.

5. An electric horn comprising:

a cup-shaped housing having an open end and a substantially flat bottom;

a diaphragm having a periphery fixed to said open end to close said housing;

an armature disposed within said housing and coupled to said diaphragm to move therewith;

an insulating plate disposed within said housing between said flat bottom and said armature, said plate having a plurality of through-holes arranged such that the distances between each through-hole and the center of said housing are substantially equal;

a plurality of cores fixed to said housing and extending through respective through-holes towards said armature; and a plurality of flat spiral coils fixed to said insulating plate and surrounding respective cores to attract said armature towards said bottom when said coils are electrically energized.

6. An electric horn according to claim 5 further comprising:

a stable contact fixed within said housing and disposed between said insulating plate and said armature;

a movable contact disposed in said housing between said insulating plate and said bottom;

a contact spring supported within said housing and carrying said movable contact in a manner whereby said movable contact is urged towards said stable contact;

said insulating plate having a hole through which said stable and movable contacts come in direct contact;

said diaphragm having substantially at the center thereof a projection extending towards said insulating plate, said projection moving together with said armature towards said housing bottom and pushing said contact spring towards said bottom so that said movable contact separates from said stable contact; and means for electrically connecting said coils to an electrical source through said stable and movable contacts.

7. An electric horn according to any one of claims 5 and 6, wherein said spiral coils are arranged in pairs fixed to opposite sides of said insulating plate, each pair surrounding a respective core, and each pair producing magnetic fluxes in the same direction.

8. An electric horn according to claim 7, wherein the number of said cores are four.

9. An electric horn according to claim 7, wherein said armature is of a circular shape.

10. An electric horn according to claim 6, wherein a tongue portion is formed in said insulating plate in such a manner that a free end of said tongue portion is disposed substantially at said center of said housing so that said projection abuts on said free end.

11. An electrical horn according to any one of claims 5, 6 and 10, wherein the direction of magnetic flux produced in one of said cores is opposite to the direction of magnetic flux produced in an adjacent core.

* * * * *